US005176442A

United States Patent [19]

Richardson

[11] Patent Number: 5,176,442

[45] Date of Patent: Jan. 5, 1993

[54] INFRA-RED COUPLING MECHANISM FOR A LIGHT PROJECTOR

[75] Inventor: Brian E. Richardson, San Jose, Calif.

[73] Assignee: Morpheus Lights, Inc., San Jose, Calif.

[21] Appl. No.: 577,414

[22] Filed: Sep. 4, 1990

[51] Int. Cl.[5] ..... F21V 21/00

[52] U.S. Cl. ..... 362/286; 362/269; 362/285; 362/287; 362/418

[58] Field of Search ..... 359/142, 143, 144, 154, 359/152, 147, 165; 362/35, 269, 271, 272, 285, 286, 287, 418, 419, 428

[56] References Cited

U.S. PATENT DOCUMENTS

| | | | |
|---|---|---|---|
| 3,842,403 | 10/1974 | Konopka | 359/147 |
| 3,924,120 | 12/1975 | Cox, III | 359/165 |
| 4,320,385 | 3/1982 | Bleiweiss et al. | 362/35 |
| 4,598,345 | 7/1986 | Kleeman | 362/272 |
| 4,797,795 | 1/1989 | Callahan | 362/272 |
| 5,031,082 | 7/1991 | Bierand | 362/272 |

FOREIGN PATENT DOCUMENTS

| | | | |
|---|---|---|---|
| 3013406 | 10/1981 | Fed. Rep. of Germany | 362/271 |

*Primary Examiner*—Ira S. Lazarus
*Assistant Examiner*—Sue Hagarman
*Attorney, Agent, or Firm*—Skjerven, Morrill, MacPherson, Franklin & Friel

[57] ABSTRACT

A light projector is presented including a wireless power coupling mechanism and infra-red communications coupling mechanism which provide a portion of the projector with the capability of complete full-circle rotation about its pan-axis. A stationary base is provided which includes a first transmitter and receiver means for transmitting control signals to and receiving information signals from a second transmitter and receiver means on the rotating portion of the projector. A pan-axis shaft includes the second transmitter and receiver means for transmitting information signals to and receiving control signals from the transmitter-receiver means on the stationary base, and is operative to rotate the rotatable portion of the projector. The infra-red coupling mechanism and wireless power coupling mechanism eliminate the need for hard-wiring between the base and rotating portion of the projector, greatly facilitating continuous and efficient motion thereof.

15 Claims, 4 Drawing Sheets

INFRA-RED COUPLING MECHANISM FOR A LIGHT PROJECTOR

BACKGROUND OF THE INVENTION

1. Field of the Invention

The present invention relates generally to lighting systems, and more particularly to a light projector including an electro-optical coupling mechanism and wireless power coupling mechanism for facilitating increased range of motion and decreased response time for projector movement.

2. Brief Description of the Prior Art

Lighting systems have enjoyed expanded consumer interest and proliferation in recent years, evolving into a standard component of concert shows and theatrical presentations. The light shows associated with these events often capture more attention than the human element involved and can provide a significant level of overall audience satisfaction. As a result, contemporary lighting systems must offer increased functional flexibility and diversity over that demanded of the lighting systems used in the past.

An example of the inflexibility in the design of prior systems is the restricted range of motion available to the individual projector units. This inflexibility is mainly caused by the placement and connection of wires between the rotational and stationary portions of a projector. Connections are frequently made through the pan-axis of the projector (as shown in U.S. Pat. No. 4,701,833) or off to the side of this axis (as shown in applicant's co-pending application Ser. No. 07/224,437). This wire placement hinders the range and direction of revolution of the fixture, often complicating the implementation of a lighting program in a show that requires ultra-accurate precision light movements and timing. Additionally, because of the restricted range of motion, the rotational portion of a projector must often backtrack up to 360 degrees in order to reach a position that is actually juxtaposed to its last operational position. This translates into a reduced response time of the rotational portion to repositioning commands, which further inhibits overall projector performance.

SUMMARY OF THE PRESENT INVENTION

It is therefore an object of the present invention to provide a light projector with increased range of motion and movement flexibility about its pan axis.

It is another object of the present invention to provide a projector of the type described which is capable of complete and continuous full-circle rotation about its pan axis in both clockwise and counter-clockwise directions.

It is a further object of the present invention to provide a projector of the type described which exhibits a decreased repositioning response time, thus increasing the speed with which the projector can be moved to and from various operational positions.

These and other objects of the present invention are achieved in the preferred embodiment by providing a light projector with an infra-red communications link for transmitting and receiving data between the rotational and non-rotational components of the projector. A housing, which contains, in part, the lighting elements, actuators and lenses of the projector, is supported by a yoke. The yoke is attached to a shaft which is rotatable via a panning mechanism secured to a stationary base. A lower command card is provided, the function of which is to, in part, facilitate control the various mechanisms within the housing. Electro-optical transmitting and receiving means are secured to the shaft and coupled to the lower card and are operative to transmit information signals to and receive control signals from separate electro-optical transmitting and receiving means coupled to a stationary control unit secured to the base.

In this manner, it is possible for the stationary control unit to transmit control signals to the lower card without using hard wiring techniques. This design configuration allows the yoke to freely revolve about the shaft without the constriction due to the wires associated with the design of prior art devices. That is, without any wires connecting the housing and yoke assembly to the stationary base, the yoke can freely and continuously rotate in either a clockwise or counterclockwise direction.

DETAILED DESCRIPTION OF THE PREFERRED EMBODIMENT

Figure 1:
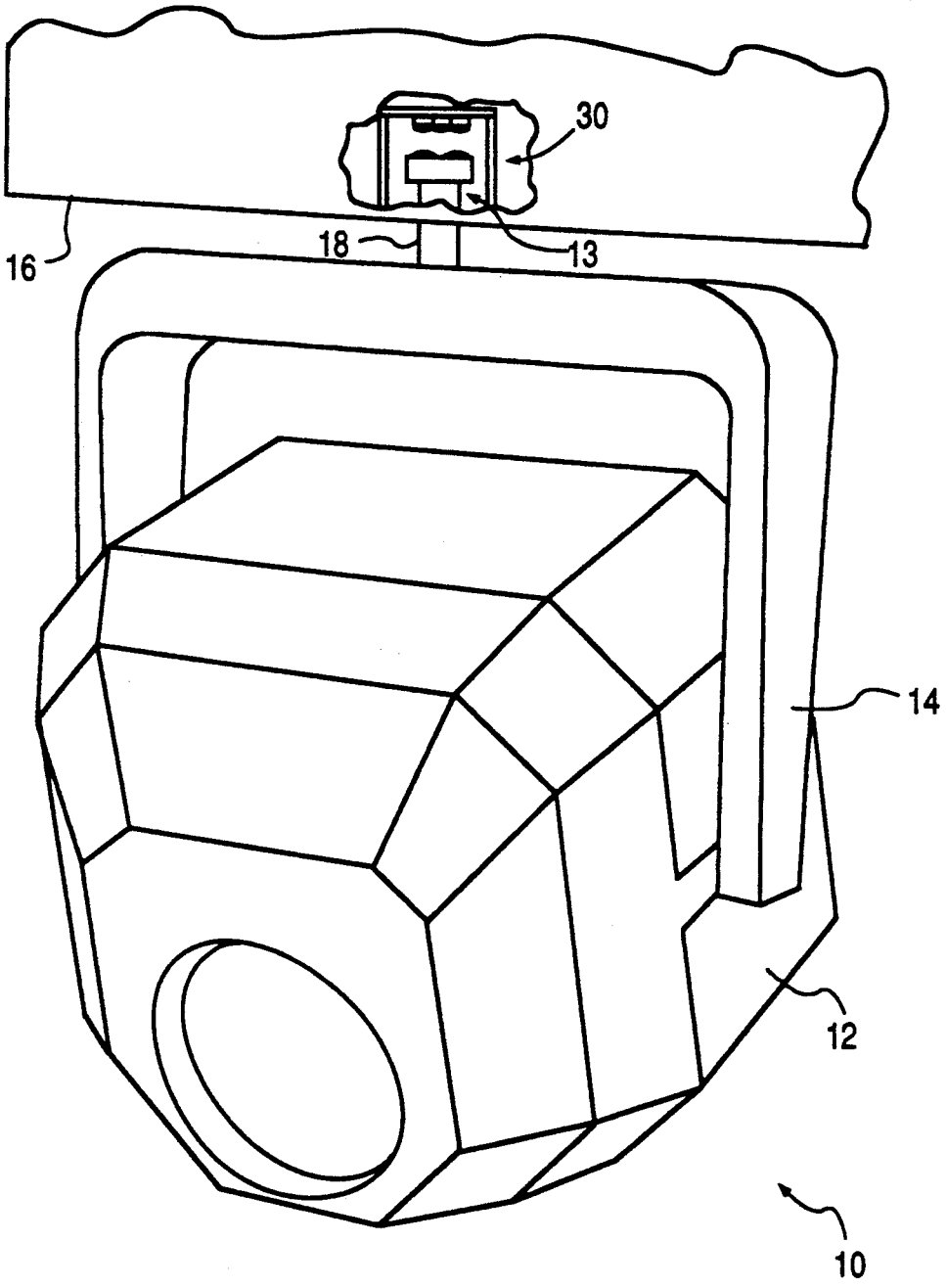
FIG. 1 is a partially broken perspective view of the housing and yolk assembly for a light projector in accordance with the preferred embodiment of the present invention.

Referring to FIG. 1, shown is the preferred embodiment of the present invention which generally comprises a lower light projector portion 10 including a housing 12 supported by a yolk 14. Yolk 14 is physically coupled to a stationary base 16 via a shaft 18 which is fixedly secured to the yolk. Shaft 18 is coupled to a panning mechanism 20 (attached to base 16 and not shown in FIG. 1) and is rotatable thereby. Housing 12 contains the light generating and influencing components of projector 10, and is movable both independently of yolk 14, at its points of suspension at the arms of the yolk, and by rotation of shaft 18 by panning mechanism 20. A more detailed description of the actuating and control elements of a projector in accordance with the preferred embodiment is provided in applicant's co-pending application Ser. No. 224,437 and U.S. Pat. No. 4,837,665, the disclosures of which are hereby incorporated by reference.

Figure 2:
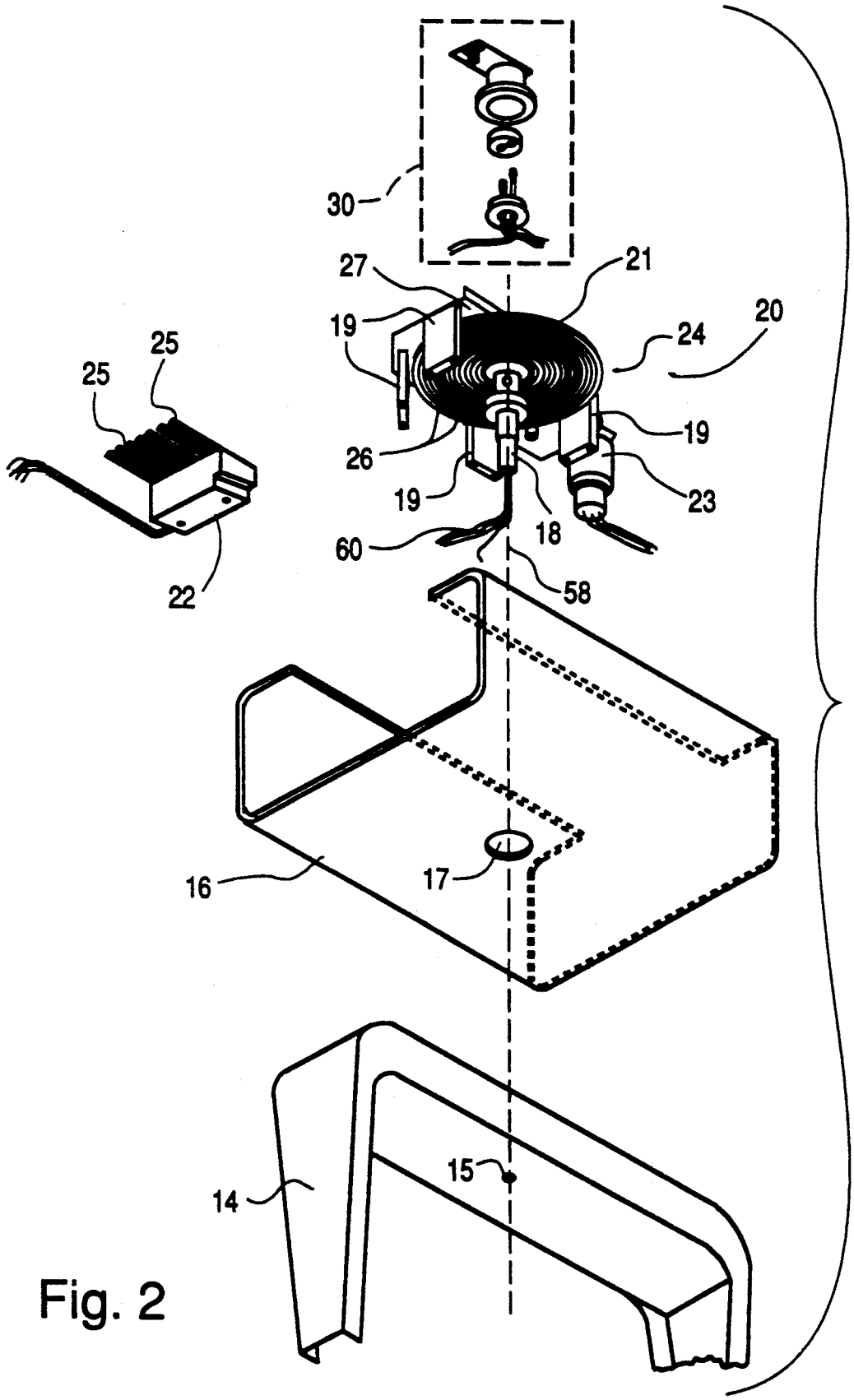
FIG. 2 is an exploded view of the yoke and base assembly, including the shaft and panning mechanism, power coupling mechanism, and infra-red coupling mechanism.

Referring now to FIG. 2, shown is an exploded view of a projector in accordance with the preferred embodiment, including panning mechanism 20, a power coupling mechanism (including a brush mechanism 22 and a contact plate 24), and an electro-optical coupling mechanism 30. In its operational embodiment, shaft 18 is positioned through hole 17 of base 16, and further secured to yolk 14 via hole 15 located centrally therethrough.

Panning mechanism 20 includes a stationary foundation 27 which is secured to base 16 by means of four connecting supports 19. A rotating gear 21 is secured to shaft 18, and is operative to turn the shaft in either a clockwise or counterclockwise direction. Motor 23 provides actuating means to drive gear 21, and receives control signals from a central control unit (not shown). One end of shaft 18 protrudes through a hole in foundation 27 (not shown in FIG. 2) and provides operational access for an electro-optical transmitter and receiver as further described below.

An important feature of the present invention is the elimination of control and power wires normally connected between the lower rotatable projector portion 10 and the upper stationary projector base 16. In the prior art devices, this hard-wiring has proved a significant hinderance to the continuous and efficient panning movement of a projector.

Power to the electrical components of lower projector portion 10, including a lower control card and the electrical elements contained within housing 12, is supplied by a wiping contact assembly which includes brush mechanism 22 and contact plate 24. Brush mechanism 22 includes a plurality of individual brushes 25 and is connected to an external power supply (not shown). Contact plate 24 includes a plurality of concentric annular copper strips 26 disposed on the outer surface thereof which ultimately provide conductive connections between brush mechanism 22 and various components of lower projector portion 10. Plate 24 is secured to the surface of gear 21 by appropriate securing means. In the preferred embodiment, an insulating sheet is placed between the gear and contact plate, and the contact plate is attached to the gear using a plurality of screws.

Brush mechanism 22 is secured to stationary base 16 and is disposed in relation to panning mechanism 20 and gear 21 such that the individual brushes 25 make substantial contact with the concentric copper strips 26 of plate 24. This coupling configuration facilitates a continuous power input path to the electrical components of the non-stationary lower portion without the difficulties associated with hard-wiring. Specifically, there are no wires connecting the rotatable lower portion 10 to base 16, and thus no Wires to become twisted or tangled by the continuous full-circle rotation of yolk 14. This arrangement accommodates unrestricted projector movement; and, although gear 21 rotates, the individual brushes of the brush mechanism make continuous contact with the copper strips of rotating plate 24, thus providing potential for an uninterrupted power supply to the various lower projector portion components.

A plurality of copper connecting strips are provided on the upper non-contacting surface of plate 24 (opposite the surface of plate 24 shown in FIG. 2) and are configured to terminate at the center region of plate 24. Electrical circuitry common in the art for the proper operation of the electro-optical coupling mechanism 30 is also included on this non-contacting surface. Conductive connections are made between the connecting strips of the non-contacting surface and the concentric copper strips 26 on the opposite surface of the plate. This configuration allows a plurality of wires 60 to be coupled to the concentric copper strips 26 at the center region of plate 24, a number of the wires 60 being operative to couple operating power to the various components of lower projector portion 10, and a number of the wires 60 being operative to couple communication signals between the lower control card and mechanism 30, as described below. Because wires 60 are connected to rotatable plate 24, and are further connected to other lower projector portion components that are rotatable by the same actuating means (panning mechanism 20), the wires are actually stationary with respect to the frame of reference of the rotating portion of the projector. This means that regardless of the direction or continuity of rotation of shaft 18, the wires remain in their proper positions, free from twisting or entanglement. A groove 36 or bore is provided along or through the longitudinal axis 58 of shaft 18 to accommodate proper positioning of the connecting wires 60 therein. This allows the wires to be efficiently and compactly disposed, further diminishing the complications normally associated with a rotational light system.

Figure 3:
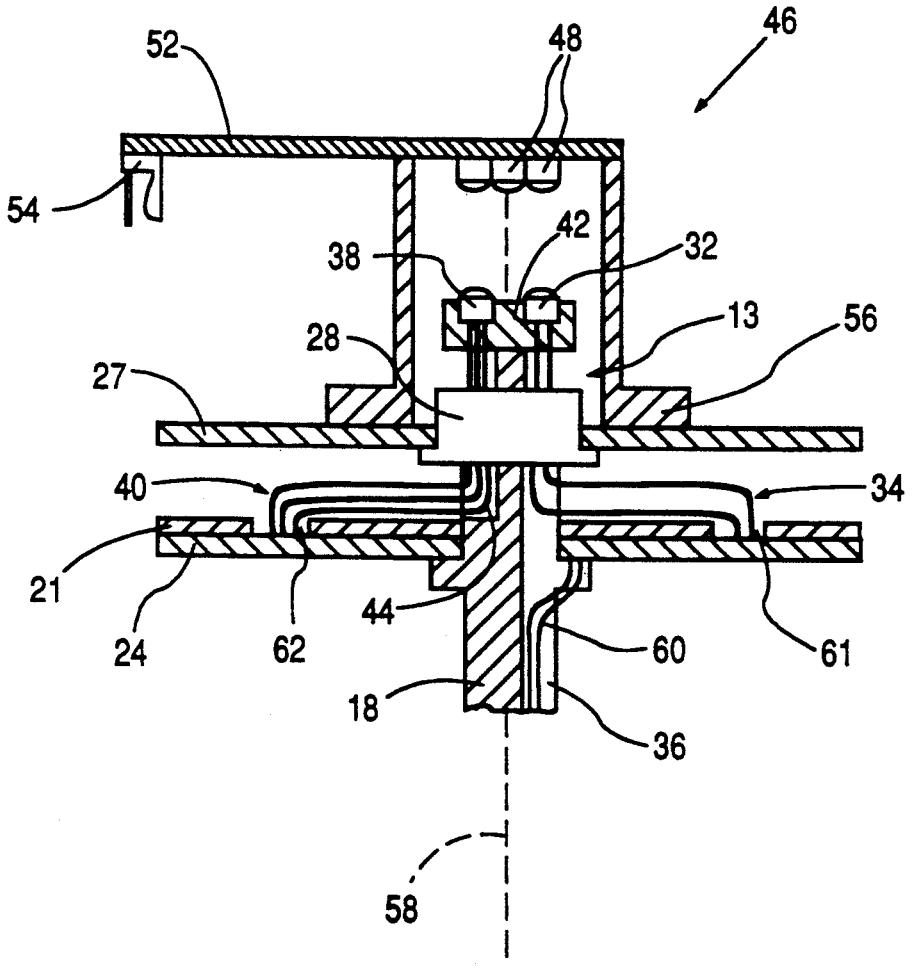
FIG. 3 is a cross-sectional view of the infra-red coupling mechanism as it appears in its operational configuration.

Referring now to FIG. 3, the electro-optical coupling mechanism 30 will now be explained in further detail. The principal function of coupling mechanism 30 is to facilitate the transmission and reception of information between the lower rotational portion 10 and the stationary portion of the projector without limiting full projector movement. This is accomplished by implementing photo-receiver and transmitter combinations in the communications portion of the projector design in place of the normal hard-wiring used in the data coupling systems of the prior art devices.

Gear 21 and plate 24 are attached to shaft 18, the distal end 13 of which protrudes through a hole centrally located through foundation 27 and coupled thereto by bearing 28. A photo-transmitter 32 and photo-receiver 38 are secured to this distal end 13 of shaft 18 by a retainer 42. Photo-transmitter 32 is connected through a hole 61 in gear 21 to a first connector on the upper surface of plate 24 via wires 34. Wires 34 are disposed within groove 36 through shaft 18. Photo-receiver 38 is connected through a hole 62 in gear 21 to a second connector on the upper surface of plate 24 via wires 40. Wires 40 are disposed within groove 44 which runs parallel to central longitudinal axis 58 through the upper portion of shaft 18. Appropriate connections are made between the first and second connectors and the connecting strips on the upper surface of plate 24 to ensure effective operation and coupling of photo-transmitter 32 and photo-receiver 38. The connecting strips coupled to photo-transmitter 32 and photo-receiver 38 are further coupled to the lower control card via a number of the connecting wires 60.

Upper communications link 46 comprises a plurality of photo-receivers 48 which surround a single photo-transmitter 50 (shown in FIG. 4*a*) all of which are connected to an upper printed circuit board 52. Connector 54 is provided to couple receivers 48 and transmitter 50 (and associated circuitry) to an appropriate control center. A cover 56 is secured to PCB 52 by appropriate securing means, and is further secured to stationary foundation 27. In this manner, cover 56 is operative to secure the entirety of upper communications link 46 to foundation 27 in a predetermined position relative to axis 58 and transmitter 32 and receiver 38 such that transmitter 50 lies along axis 58 directly above the center of shaft 18. Cover 56 is further operative to provide physical protection for receiver 38 and transmitter 32, as well as receivers 48 and transmitter 50.

In operation, information signals are sent by transmitter 32 to receivers 48 which subsequently relay the received signals to the control center of the projector. These information signals normally contain position information and the like which allow the control center to make position adjustments and output further position commands Because transmitter 32 (and receiver 38) is secured to shaft 18 by retainer 44, it will rotate in the same direction and at the same rate as the shaft. A continuous communications link is established by providing a plurality of receivers 48 each of which is operative to receive communications signals, in effect acting in the conjunctive as a single reception source. As is depicted in FIG. 4*b*, transmitter 32, which is affixed to shaft 18, is limited to an orbital path circumscribed about the center longitudinal axis 58 and having a radius equal to transmitter 32's distance from the axis. Receivers 48 are arranged such that they lie in a fixed circular pattern having substantially the same diameter as the circular path around which transmitter 32 must travel. Thus, regardless of the position of transmitter 32 during the rotation of shaft 18, a sufficient communicative link will be established between transmitter 32 and at least one of the receivers 48 such that information signals can be effectively transmitted and received.

Figure 4A:
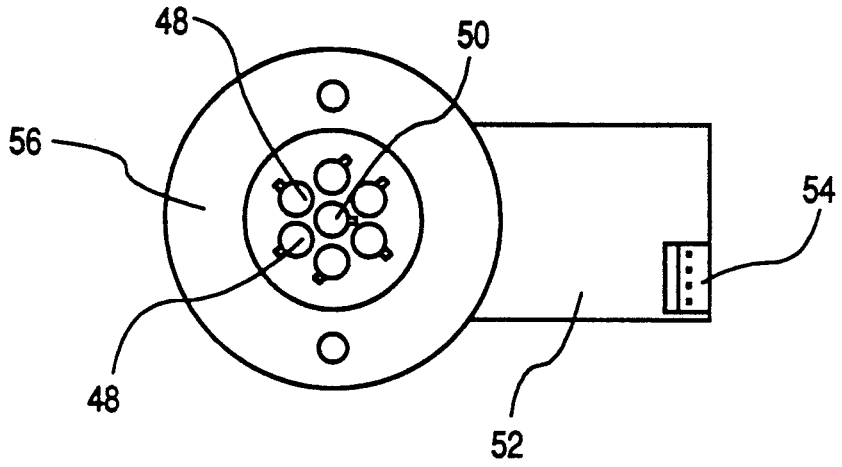
FIG. 4*a* is a plan view of the stationary base-mounted transmitting and receiving means of the infra-red coupling mechanism.
Figure 4B:
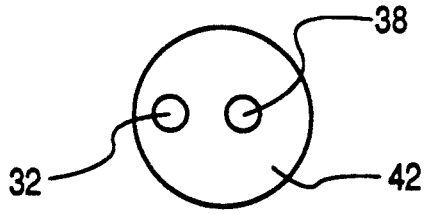
FIG. 4*b* is a plan view of the distal end of the shaft with the retaining means secured thereto.

In the preferred embodiment depicted in FIG. 4*a*, six receivers 48 are closely arranged in a circular path, the diameter of which is substantially the same as the diameter of the circular path that transmitter 32 must travel along during the rotation of shaft 18. Because of the close proximity between each of the receivers 48, an effective communicative link is established with transmitter 32 regardless of its position along its orbital path. That is, the physical gaps between the juxtaposed receivers 48 are insufficient to cause a communications breakdown even if transmitter 32 is positioned between two adjacent receivers. A signal of sufficient strength will be received by the adjacent receivers individually or in combination to accommodate reception from the transmitter.

Transmitter 50 is provided to transmit control signals from the upper projector portion to receiver 38 and further on to the lower control card. Receiver 38, like transmitter 32 described above, is limited to movement in a circular path around the central longitudinal axis 58 of shaft 18. A continuous communications link is established between transmitter 50 and receiver 38 by angling receiver 38 with respect to axis 58, and towards transmitter 50. When receiver 38 is set at the proper angle, a communicative path is established between transmitter 50 and receiver 38 regardless of the rotational position of shaft 18. This communicative path is independent of shaft rotation because the angle at which receiver 38 is disposed relative to transmitter 50 remains constant, regardless of this rotation. Thus, once receiver 38 is angled appropriately, such that signal reception is achieved from transmitter 50, there will be a constant viable path for the transmission and reception of communication signals.

It should be noted that the above described specific transmitter-receiver arrangement is not integral to the operation of the infra-red coupling mechanism. The prominent feature of the coupling mechanism is the implementation of communication means which obviate the need for hard-wiring between the rotating and stationary components of the projector. Thus any transmitter-receiver arrangement which is capable of effectuating these ends are contemplated. Thus, a single directional communications link could be established by providing a single transmitter, for transmitting control signals from a control center, and single receiver, for receiving these signals and relaying them to the operative components of the projector.

One embodiment employing this single transmitter and receiver arrangement would include a photo-receiver centrally located on the end of the shaft which couples the rotatable portion to the stationary base, and a photo-transmitter mounted to the base where the central longitudinal axis of the shaft intersects the base. This arrangement would provide a constant communications path regardless of shaft rotation. Additionally, other physical arrangements of the transmitters and receivers could be utilized in effectuating a one-way or two-way communications link without disturbing the overall effectiveness of the present invention.

Although the present invention has been described in terms of a preferred embodiment, it will be appreciated by those skilled in the art that modifications thereof may be made without departing from the essence of the invention. It is therefore intended that the following claims be interpreted as covering any and all such modifications falling within the true spirit and scope of the invention.

What is claimed is:

1. A light projector of the type including a stationary portion having a panning mechanism mounted thereon and a rotatable portion suspended from said stationary portion by a support means coupled by a rotatable shaft to said panning mechanism, and further including a communications means for coupling information and control signals between the stationary portion and the rotatable portion, said communications means comprising:

first transmitting and receiving means affixed to said rotatable portion; and second transmitting and receiving means affixed to said stationary portion for transmitting signals to and receiving signals from said first transmitting and receiving means, said first transmitting and receiving means and said second transmitting and receiving means being conjunctively operative to communicatively couple information between said upper and lower portions during continuous full-circle rotation of said rotatable portion relative to said stationary portion.

2. A light projector as described in claim 1 wherein said first transmitting and receiving means includes a first photo-transmitter unit and a first photo-receiver unit, and further wherein said second transmitting and receiving means includes a second photo-transmitter unit and a second photo-receiver unit for optically communicating with said first photo-transmitter and photo-receiver units whereby information signals can be coupled between said rotatable and stationary portions without the use of wires connected therebetween.

3. Improved communications means as described in claim 2 wherein said first photo-transmitter unit and first photo-receiver unit are secured to one end of said rotatable shaft, and further wherein said second photo-transmitter unit and second photo-receiver unit are disposed on said stationary portion opposite said one end whereby said information is effectively coupled between said stationary and rotatable portions regardless of the rotational position of said shaft.

4. A light projector as described in claim 3 wherein said first photo-transmitter unit and first photo-receiver unit are disposed on opposite sides of said one end of said shaft, and wherein said second photo-receiver unit includes a plurality of individual second photo-receivers which surround said second photo-transmitter, said second photo-receivers being disposed in a circular path having a diameter substantially equal to the diameter of the circular path circumscribed by said first photo-transmitter during rotation of said shaft, and further wherein said first photo-receiver is angled with respect to the longitudinal axis of said shaft and directed towards said second photo-transmitter, whereby information signals are effectively coupled between said rotatable and stationary portions regardless of the rotational position of said shaft.

5. A light projector comprising:

a stationary projector portion including a base with panning mechanism secured thereto;

a rotatable projector portion, including a housing and support means for retaining said housing;

a shaft having a first end and a second end, said first end being fixedly attached to said support means and said second end being fixedly attached to said panning mechanism, said panning mechanism being operative to effectuate rotation of said shaft, thereby effectuating rotation of said rotatable projector portion;

power coupling means for supplying electrical operating power to electrical components of said rotatable projector portion from said upper projector portion without the use of wires connected therebetween, said power coupling means functioning to supply power during continuous full-circle rotation of said rotatable portion; and, communication coupling means for transmitting and receiving control and information signals between said rotatable portion and said stationary portion without the use of wires connected therebetween, said communication coupling means functioning to supply said control and information signals during continuous full-circle rotation of said rotatable portion.

6. A light projector as described in claim 5 wherein said power coupling means includes a contact means secured to said shaft for providing a conductive path to said rotatable projector portion, and a brush means secured to said base and disposed such that substantial contact is made with said contact means, said brush means receiving power from a remote power source and being operative to couple said power to said contact means at all rotational positions of said shaft.

7. A light projector as described in claim 6 wherein said contact means comprises a circular plate with a plurality of individual annular conductive contact strips which are connected to various electrical components of said rotatable projector portion, and further wherein said brush means includes a plurality of individual brush members disposed in a manner to make substantial electrical contact with said individual strips such that said electrical contact is maintained even during continuous rotation of said shaft.

8. A light projector as described in claim 5 wherein said communication coupling means includes first electro-optical transmitter and receiver means disposed on said rotatable portion and second electro-optical transmitter and receiver means disposed on said stationary portion for establishing a wireless communications signal path between said rotatable and stationary portions.

9. A light projector as described in claim 8 wherein said first electro-optical transmitter and receiver means includes a first photo-transmitter and a first photo-receiver, both of which are attached to said second end of said shaft, and further wherein said second electro-optical transmitter and receiver means includes a second photo-transmitter and a plurality of second photo-receivers attached to said base and disposed in relation to said first electro-optical transmitter and receiver means such that a continuous communications path is provided between the rotatable and stationary projector portions regardless of the rotational position of said shaft.

10. A light projector as described in claim 9 wherein said plurality of second photo-receivers are arranged in compact relationship about said second photo-transmitter, whereby at least one of said plurality of second photo-receivers is disposed directly above said first photo-transmitter and further wherein said first photo-receiver is angled with respect to the central longitudinal axis of said shaft and toward said second photo-transmitter such that signals transmitted from said stationary projector portion can be continuously received by said rotatable projector portion and signals transmitted from said rotatable projector portion can be continuously received by said stationary projector portion at all rotational positions of said shaft and lower projector portion.

11. An individual light projector of a lighting system comprising a communications coupling mechanism, said communications coupling mechanism comprising:

a stationary base including a central control unit;

a rotatable portion including a local control unit;

a rotatable shaft having a first end and a second end, said first end being coupled to said stationary base and said second end being coupled to said rotatable portion, for coupling said rotatable portion to said stationary base;

first transmitter and receiver means attached to said rotatable portion for receiving control signals from said central control unit and for transmitting information signals to said central control unit;

second transmitter and receiver means attached to said stationary base for relaying control signals to said first receiver means from said central control unit and for relaying information signals to said central control unit from said first transmitter.

12. A light projector as described in claim 11 wherein said first transmitter and receiver means includes a first photo-transmitter unit and first photo-receiver unit, and further wherein said second transmitter and receiver means includes a second photo-transmitter unit and second photo-receiver unit disposed in communicative relationship to said first photo-transmitter and receiver units, whereby effective relay of said control and information signals is achieved between said rotating portion and said stationary base.

13. A light projector as described in claim 12 wherein said first photo-transmitter unit and first photo-receiver unit are disposed at said second end of said shaft, and wherein said second photo-receiver unit includes a plurality of individual second photo-receivers which surround said second photo-transmitter forming a substantially circular configuration with a diameter substantially equal to the diameter of the circular path circumscribed by said first photo-transmitter during rotation of said shaft, and further wherein said first photo-receiver is angled with respect to the longitudinal axis of said shaft and towards said second photo-transmitter, whereby information signals are effectively coupled between said rotatable and stationary portions at all rotational positions of said shaft.

14. A light projector comprising a communications coupling mechanism which includes a rotatable portion coupled by a shaft to a stationary portion, said communication coupling mechanism comprising:

transmitter means mounted to said stationary portion for transmitting control signals to said rotatable portion;

receiver means mounted to said rotatable portion for receiving control signals from said transmitter means, said transmitter means and receiver means effectively establishing a communicative link between said rotatable and stationary portions without the connection of wires therebetween, and providing said rotatable portion with the capability of uninterrupted communications during continuous full-circle rotation relative to said stationary portion.

15. The light projector as described in claim 14 wherein said receiver means includes a photo-receiver disposed upon said shaft coupled to said rotatable portion, and further wherein said transmitter means includes a photo-transmitter disposed in a direct optical line with said photo-receiver such that a communicative link is established therebetween at all rotational positions of said shaft.

* * * * *